United States Patent [19]

Witte

[11] 4,343,120

[45] Aug. 10, 1982

[54] STAIR STRUCTURE FOR SWIMMING POOLS

[75] Inventor: Donald H. Witte, Arlington, Tex.

[73] Assignees: Carl R. Meyer; Carol S. Meyer, both of Port Isabel, Tex.

[21] Appl. No.: 131,221

[22] Filed: Mar. 17, 1980

[51] Int. Cl.[3] ..... E04F 11/00

[52] U.S. Cl. ..... 52/184; 52/191; 52/169.7

[58] Field of Search ..... 52/182, 184, 188, 191, 52/169.7, 828, 827

[56] References Cited

U.S. PATENT DOCUMENTS

| | | | |
|---|---|---|---|
| 2,205,859 | 6/1940 | O'Donnell | 52/188 |
| 3,236,012 | 2/1966 | Laven | 52/184 |
| 3,374,491 | 3/1968 | Patin | 52/184 |
| 3,468,088 | 9/1969 | Miller | 52/169.7 |
| 3,744,198 | 7/1973 | Boassy | 52/184 |
| 3,755,981 | 9/1973 | West | 52/184 |
| 3,848,378 | 11/1974 | Witte | 52/184 |
| 3,888,058 | 6/1975 | Ahrens | 52/191 |
| 3,978,628 | 9/1976 | Turner | 52/188 |
| 4,044,514 | 8/1977 | Rubin | 52/169.7 |

FOREIGN PATENT DOCUMENTS

| | | | |
|---|---|---|---|
| 599115 | 3/1948 | United Kingdom | 52/182 |

*Primary Examiner*—Price C. Faw, Jr.
*Assistant Examiner*—Henry E. Raduazo
*Attorney, Agent, or Firm*—Bacon & Thomas

[57] ABSTRACT

A swimming pool has a sidewall and a flexible liner, the sidewall defining an outwardly extending bay having opposed sidewalls between which a stair assembly is sealingly secured. The stair assembly is a molded structure having a continuous depending flange at the ends of the treads and risers and a hollow triangular stiffening rib extending longitudinally and generally centrally along the underside of each tread. A continuous coping embraces the upper edge of the pool sidewall, the upper edges of the opposed sidewalls and the upper edge of the top riser of the stair assembly. The opposed sidewalls of the bay are metal plates to which the depending flanges of the stair assembly are secured and those plates have edge flanges sealed to the edges of the flexible liner at the sides of the bay.

18 Claims, 4 Drawing Figures

32
4
36
2
28
26
40
28
10
42
8
14
16
6
16
18
10
12
8
16
6
6
6
8
10
10
40
28
28
26
40
36
32
2

STAIR STRUCTURE FOR SWIMMING POOLS

BACKGROUND OF THE INVENTION

This invention is in the field of plastic lined type swimming pools and relates particularly to stairs therefor.

It has been proposed previously to mount stairs leading from a swimming pool in a recess or bay in a wall of the pool. Such stairs have conventionally been molded as a single structure with integral sidewalls extending upwardly and were quite bulky and difficult to store. See, for example, U.S. Pat. Nos. 3,744,198, 3,755,981, 3,848,378 and 3,236,012. Those patents disclose various types of stairs for swimming pools positioned in a recess in a sidewall of the pool. The U.S. Pat. No. 3,744,198 is only loosely mounted in the recess and necessitates extending the pool liner into the recess or bay to maintain integrity of the pool. The remaining patents show one-piece molded or otherwise fabricated stair structures that are obviously quite bulky to handle or store.

SUMMARY OF THE INVENTION

The present invention contemplates a stair for a swimming pool which is molded in one piece and comprises a laminar structure including reinforcing ribs below the stair treads. The stair is provided with a fairly narrow depending flange adapted to be bolted to the sidewalls of a recess or bay with sealing material therebetween to effect a water-tight seal between the stairs and the walls of the bay. The sidewalls of the bay are flanged and extend inwardly of the pool to overlie adjacent edges of the pool wall and means are provided for sealing the pool liner edges, at the sides of the bay, to the flanges of the sidewalls of the bay. In addition, a continuous coping extends along the top of the pool wall, the top edges of the sidewalls of the bay and across the top of the uppermost riser of the stairs.

DESCRIPTION OF A PREFERRED EMBODIMENT

Figure 1:
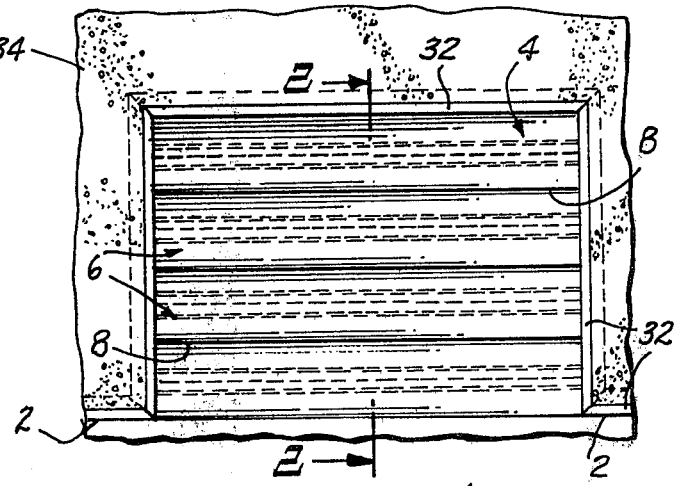
FIG. 1 is a fragmentary plan view of a swimming pool having a stairwell for the pool, according to the present invention.

FIG. 1 of the drawing shows a portion of a swimming pool having sidewalls 2 and a bay or recess 4 extending outwardly from the pool wall and in which the stairs of the present invention are located.

Figure 2:
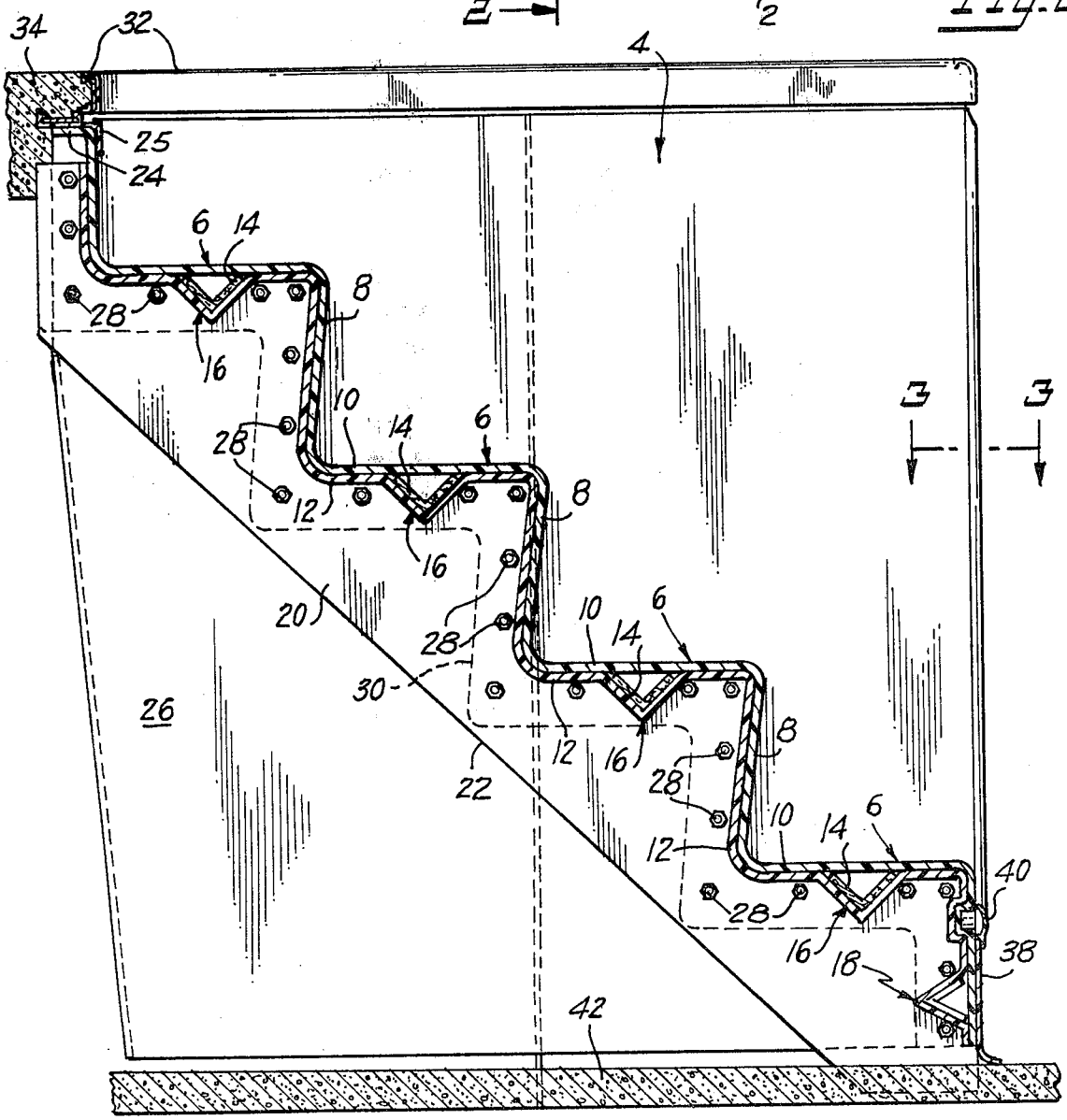
FIG. 2 is an enlarged fragmentary vertical sectional view, taken on the line 2—2 of FIG. 1.

FIG. 2 illustrates in greater detail the structure of the stairs and shows a stairway having treads 6 of generally planar configuration and risers 8 also generally planar. The treads and risers are constructed of folded fibrous material impregnated with suitable resin binder and, as shown, an upper or outer layer of the fibrous material is identified at 10 and lower, or inner layer, at 12. While only two layers 10 and 12 are shown, the invention contemplates a structure of any desired number of layers. Obviously, the structure could be formed by vacuum forming or otherwise molded, or be made of metal sheets. Extending generally longitudinally and substantially medially of each of the treads 6 is a folded length of paperboard 14 over which the outer layer of fibrous material extends. Thus, when the material is cured and hardened, the treads are provided with longitudinally extending hollow generally triangular reinforcing ribs 16. The ribs 16, however, are only one example of suitable rigidizing means. As shown in FIG. 2, the lowermost riser of the stair structure is also provided with a hollow triangular reinforcing rib 18. Integrally molded with the stair structure described are side flanges 20 extending downwardly to define a continuous lower edge 22. As also shown, the upper layer 6 of material extends upwardly, at the uppermost riser, to define a flange 24 extending outwardly.

As will be apparent, the molded stair structure thus described may be readily stacked by inverting one unit and nesting the stair treads and risers of that unit with the treads and risers of a corresponding unit and thus forming a compact package, relatively easy to handle and store.

The bay or recess 4 is defined by side plates 26 extending rearwardly from the edges of the pool walls to define the sidewalls of the bay. The stair assembly is mounted between the side plates 26 and may be bolted thereto by bolts 28 and a sealing gasket 30 is preferably interposed between the flanges 20 and the plates 26 to seal the ends of the stairs against leakage of water from the pool. Thus, it is not necessary to line the recess below the stairs with the liner material of the pool and it is further not necessary to line the sidewalls of the recess itself with the liner.

As shown in FIGS. 1 and 2 a continuous bendable coping 32 of the type described and claimed in my copending application Ser. No. 131,222, filed Mar. 17, 1980, extends continuously along the top edge of the pool wall and along the top edges of the side plates 26 and also extends along the upper edge of the riser. However, along the top of the upper riser, the outer flange of the coping is removed and the coping rests on flange 24 with inner coping flange 25 lying against the inner face of the upper riser.

It is also contemplated that the pool will be completed by means of a concrete apron 34, as also described in applicant's copending application.

Figure 3:
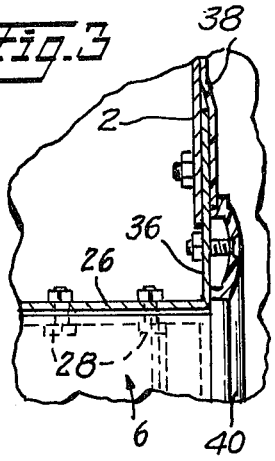
FIG. 3 is a fragmentary horizontal sectional view, taken on the line 3—3 of FIG. 2.

Referring now to FIG. 3, at their inner or pool ends, the plates 26 are provided with flanges 36 extending laterally thereof and which are preferably bolted or otherwise secured to the sidewalls 2 of the pool. The pool liner 38 which is conventionally a flexible plastic material, extends over the outer edge of the flanges 36 and is sealed thereto by means of a trim strip or molding 40, is bolted or otherwise secured to the flanges 36 and has a portion overlying and clamping the edge of pool liner 38, and thus provides a seal between the pool liner 38 and the recess or bay in which the stairs are positioned.

Figure 4:
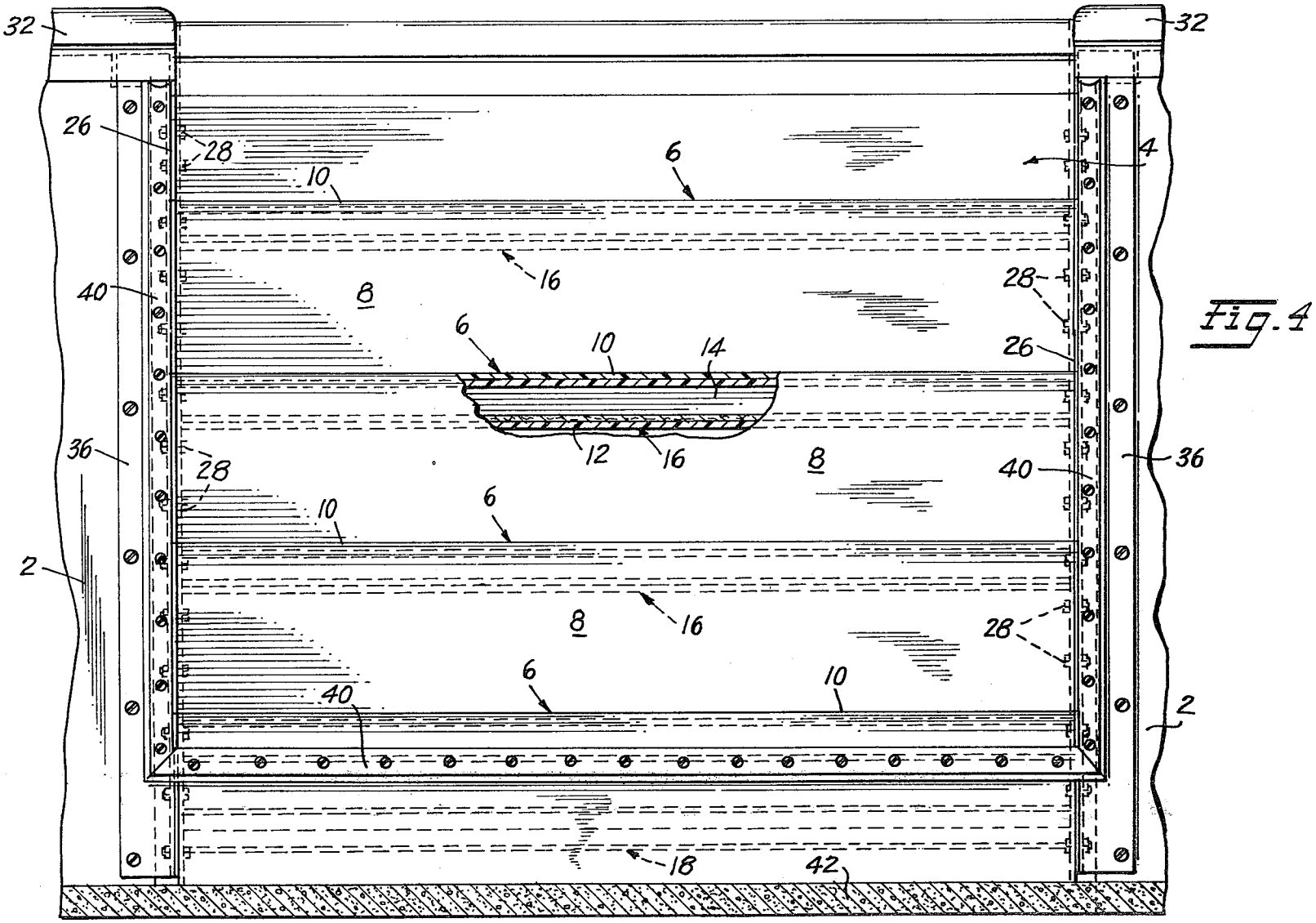
FIG. 4 is a front elevational view, partly in section, of the stairwell of FIG. 1.

As shown in FIG. 4, the trim or molding 40 extends not only along the sides of the bay, but also along the front edge of the stairs spaced upwardly from the bottom of the pool.

In the drawings numeral 42 designates a concrete base at least under the recess or bay in which the stairs are positioned, to support side plates 4.

While a single specific embodiment of the invention has been shown and described herein, the same is merely illustrative of the principles involved, other forms may be resorted to within the scope of the appended claims.

I claim:

1. A modular component stair structure for a swimming pool, which stair structure comprises:
(a) a stair assembly including integral stair treads and risers;
(b) integral side flanges extending downwardly and rearwardly from the opposed ends of the treads and risers;
(c) a pair of wall plates carried by the side flanges, with each wall plate extending downwardly and rearwardly from the flanges for supporting vertical compression loading imposed on the stair assembly; and
(d) means extending linearly along and in the general configuration of the opposed ends of the tread and risers for substantially their entire lengths for watertight compression sealing the side flanges to the wall plates.

2. The stair structure of claim 1 wherein the uppermost riser of the stair assembly terminates in an outwardly extending flange at its upper edge.

3. The stair structure of claim 1 wherein the wall plates include laterally extending flanges for securing the wall plates to the wall of the swimming pool.

4. The stair structure of claim 1 wherein the means for compression sealing each side flange includes:
(a) a compression gasket; and
(b) a plurality of mechanical fasteners.

5. The stair structure of claim 1 wherein the stair assembly comprises plural layers of fibrous material impregnated with and bonded together by a resin binder with at least one layer defining the upper surface of the treads and risers.

6. The stair structure of claim 5 further including means carried by the stair assembly for stiffening same.

7. A modular component stair structure for a swimming pool, which stair structure comprises:
(a) a pair of opposed wall plates for supporting compression loading;
(b) an integral stair assembly disposed between the wall plates and including stair treads and risers formed from plural layers of fibrous material impregnated with and bonded together by resin binder with at least one layer defining the upper surface of the treads and risers;
(c) stiffening means including a V-shaped member extending along the lower surface of a first layer of fibrous material and at least one second layer of fibrous material bonded to the first layer and the outer surface of the V-shaped member to define a hollow triangular stiffening rib under each tread;
(d) integral side flanges extending downwardly and rearwardly from the ends of the treads and risers; and
(e) means for compression sealing each side flange to a corresponding wall plate.

8. The stair structure of claim 7 wherein the V-shaped member includes a folded length of paperboard.

9. In a swimming pool having a generally vertical side wall and flexible liner, and wherein the vertical side wall is configured to define an outwardly extending bay having opposed side walls;
(a) a stair assembly including integral stair treads and risers;
(b) integral side flanges extending downwardly and rearwardly from the opposed ends of the treads and risers;
(c) a pair of wall plates carried by the side flanges, with each wall plate extending downwardly and rearwardly from the flanges for supporting vertical compression loading imposed on the stair assembly;
(d) means for securing each wall plate to the vertical side wall; and
(e) means extending linearly along and in the general configuration of the opposed ends of the treads and risers for substantially their entire lengths for watertight compression sealing the side flanges to the wall plates.

10. The swimming pool of claim 9 wherein the means for securing each wall plate to the vertical side wall includes a lateral flange carried by each wall plate.

11. The swimming pool of claim 10 further including means for clamping the pool liner to the lateral flanges of the wall plates and stair assembly.

12. The swimming pool of claim 9 wherein the uppermost riser of the stair assembly terminates in an outwardly extending flange at its upper edge.

13. The swimming pool of claim 12 further including a continuous bendable coping member having spaced depending flanges embracing the upper edge of the vertical side wall, the upper edges of the opposed side walls, and the upper edge of the uppermost riser.

14. The swimming pool of claim 9 wherein the means for compression sealing each side flange includes:
(a) a compression gasket; and
(b) a plurality of mechanical fasteners.

15. The swimming pool of claim 9 wherein the stair assembly is defined by plural layers of fibrous material impregnated with and bonded together by a resin binder, with at least one layer defining the upper surface of the treads and risers.

16. The swimming pool of claim 15 further including means carried by the stair assembly for stiffening same.

17. In a swimming pool having a generally vertical side wall and flexible liner, and wherein the vertical side wall is configured to define an outwardly extending bay having opposed side walls;
(a) a pair of wall plates, with each wall plate being exposed adjacent an opposed side wall and including means for securing each wall plate to the vertical side wall;
(b) an integral stair assembly disposed between the wall plates and including stair treads and risers wherein the stair assembly is defined by plural layers of fibrous material impregnated with and bonded together by a resin binder, with at least one layer defining the upper surface of the treads and risers;
(c) stiffening means including a V-shaped member extending along the lower surface of the first layer of fibrous material and at least one second layer of fibrous material bonded to the first layer and the outer surface of the V-shaped member to define a hollow triangular stiffening rib under each tread;
(d) integral side flanges extending downwardly and rearwardly from the ends of the treads and risers; and
(e) means for compression sealing each side flange to a corresponding wall plate.

18. The swimming pool of claim 17 wherein the V-shaped member is a folded length of paperboard.

* * * * *